US006519428B1

(12) United States Patent
Ohtoshi et al.

(10) Patent No.: US 6,519,428 B1
(45) Date of Patent: Feb. 11, 2003

(54) IMAGE FORMING APPARATUS HAVING MIXED TONER CONSUMPTION MODE

(75) Inventors: Megumi Ohtoshi, Kanagawa (JP); Masumi Sato, Kanagawa (JP); Hitoshi Ishibashi, Tokyo (JP); Yoshinori Ozawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/712,178

(22) Filed: Nov. 15, 2000

(30) Foreign Application Priority Data

Nov. 15, 1999 (JP) ..... 11-323674
Aug. 4, 2000 (JP) ..... 2000-237816
Oct. 10, 2000 (JP) ..... 2000-309859

(51) Int. Cl.[7] ..... G03G 15/00
(52) U.S. Cl. ..... 399/71; 399/299; 399/359
(58) Field of Search ..... 399/179, 299, 399/359, 71, 306; 347/115, 232

(56) References Cited

U.S. PATENT DOCUMENTS 6,212,344 B1 * 4/2001 Takagi et al. ..... 399/112
6,332,063 B1 * 12/2001 Ozawa et al. ..... 399/149

FOREIGN PATENT DOCUMENTS

JP 08137174 A * 5/1996 ..... G03G/15/01
JP 9-146334 6/1997
JP 9-288397 11/1997
JP 11282225 A * 10/1999 ..... G03G/15/01

* cited by examiner

*Primary Examiner*—Robert Beatty
(74) *Attorney, Agent, or Firm*—Oblon, Spivak, McClelland, Maier & Neustadt, P.C.

(57) ABSTRACT

An image forming apparatus of the present invention includes a plurality of image carriers sequentially arranged in a direction of paper conveyance. Developing devices each form a toner image of particular color on one image carrier associated therewith. Cleaning devices each remove residual toner left on the surface of the associated image carriers after the transfer of the toner image to the recording medium. A toner recycling device is provided between the cleaning device located at the most upstream position in the direction of paper conveyance and the developing device associated therewith, but not provided between the cleaning device located at the most downstream position the developing device assigned therewith. With this configuration, the apparatus obviates troubles ascribable to the mixture of toner of different colors occurring in the most downstream developing device. In addition, at a time other than the time of transferring toner images from the image carriers to the recording medium, a controller activates a mixed toner consumption mode such that any one of the developing devices, other than a developing device located at most upstream position in the direction of conveyance of the recording medium, is caused to deposit toner on the image carrier which is than transferred to a recording medium carrier and then cleaned to remove the toner.

24 Claims, 6 Drawing Sheets

IMAGE FORMING APPARATUS HAVING MIXED TONER CONSUMPTION MODE

BACKGROUND OF THE INVENTION

The present invention relates to an image forming apparatus of the type forming a toner image on an image carrier, transferring the toner image from the image carrier to a recording medium, and cleaning the image carrier with a cleaning device after the image transfer.

An image forming apparatus of the type described is implemented as, e.g., an electrophotographic copier, a printer, a facsimile apparatus or a multiplex machine operable as at least two of them. Further, the image forming apparatus may be implemented as a so-called tandem image forming apparatus including a plurality of image carriers. The image carriers are sequentially arranged in a direction in which a paper sheet or similar recording medium is conveyed (direction of paper conveyance hereinafter). A plurality of developing devices each face a particular image carrier and form a toner image of particular color on the image carrier. Toner images so formed on the image carriers are sequentially transferred to a paper sheet one above the other. A particular cleaning device is assigned to each image carrier in order to remove toner left on the image carrier after the image transfer. Toner collected by the individual cleaning device should preferably be returned to the associated developing device and again used to form a toner image. This successfully saves toner and therefore promotes the efficient use of limited resources. Let such a system be referred to as a toner recycling system.

However, the tandem image forming apparatus using the toner recycling system has the following problem left unsolved. After a toner image has been transferred from one image carrier positioned at the upstream side in the direction of paper conveyance to a paper sheet, toner forming the toner image is transferred from the paper sheet to the next image carrier positioned at the downstream side although in a small amount. The cleaning device assigned to the downstream image carrier collects the extraneous toner together with expected toner deposited on the image carrier. As a result, a mixture of toner of different colors is returned to the developing device. The mixture of toner would degrade the quality of the resulting color image, particularly color reproducibility, if again used to form a toner image on the image carrier.

Technologies relating to the present invention are disclosed in, e.g., Japanese Patent Laid-Open Publication Nos. 9-146334 and 9-288397.

SUMMARY OF THE INVENTION

It is therefore an object of the present invention to provide an image forming apparatus capable of obviating or effectively reducing the degradation of an image when the toner recycling system is applied to a tandem image forming apparatus.

In accordance with the present invention, an image forming apparatus includes at least two image carriers sequentially arranged in the direction of conveyance in which a recording medium is conveyed. Developing devices each form a toner image of a particular color on one image carrier. Cleaning devices each remove residual toner left on the surface of one image carrier after the transfer of the toner image to the recording medium. Toner recycling devices each return the residual toner removed from one image carrier by the cleaning device assigned thereto to one developing device that forms the toner image on the above image carrier. The toner recycling device is provided between one cleaning device, which removes the residual toner from the associated image carrier located at the most upstream position in the direction of conveyance, and one developing device assigned to the above image carrier, but not provided between another cleaning device, which removes the residual toner from another image carrier located at the most downstream position, and another developing device assigned to the above image carrier.

Also, in accordance with the present invention, an image forming apparatus includes at least two image carriers sequentially arranged in the direction of conveyance in which a recording medium is conveyed. Developing devices each form a toner image of a particular color on one image carrier. Cleaning devices each remove residual toner left on the surface of one image carrier after the transfer of the toner image to the recording medium. Toner recycling devices each return the residual toner removed from one image carriers by the cleaning device assigned to the image carrier to one developing device that forms the toner image on the above image carrier. The toner recycling device is present between one cleaning device, which removes the residual toner from the associated image carriers located at the most upstream position in the direction of conveyance, and one developing device assigned to the image carrier and between another cleaning device, which removes the residual toner from at least one image carrier other than the image carrier located at the most upstream position, and another developing device assigned to the image carrier. One of the developing devices, to which the residual toner is returned by the toner recycling device, located at the most downstream position, stores black toner for forming a black toner image.

Further, in accordance with the present invention, an image forming apparatus includes at least two image carriers sequentially arranged in the direction of conveyance in which a recording medium is conveyed. Developing devices each form a toner image of a particular color on one image carrier. A recording medium carrier conveys the recording medium. Cleaning devices each remove residual toner left on the surface of one image carrier after the transfer of the toner image to the recording medium. A cleaner removes toner deposited on the recording medium carrier. A toner recycling device is provided between at least one of the cleaning devices and one developing device associated with the cleaning device for returning the residual toner removed from one image carrier by the above cleaning device to the developing device. At a time other than a time for transferring toner images from the image carriers to the recording medium, a controller controls a mixed toner consumption mode which causes any one of the developing devices other than one located at the most upstream position in the direction of conveyance to deposit the toner on the associated image carrier, transfers the toner to the recording medium carrier, and causes the cleaner to remove the toner from the recording medium carrier.

Moreover, in accordance with the present invention, an image forming apparatus includes at least two image carriers sequentially arranged in the direction of conveyance in which a recording medium is conveyed. Developing devices each form a toner image of a particular color on one image carrier. Cleaning devices each remove residual toner left on the surface of one image carrier after the transfer of the toner image to the recording medium. Toner recycling devices each return the residual toner removed from one image carrier by the cleaning device assigned to the image carrier to one of the developing devices that forms the toner image on the above image carrier. The toner recycling devices each are provided between one of the cleaning devices and one developing device assigned to one image carrier, from which the cleaning device removes the residual toner. One of two developing devices adjoining each other in the direction of conveyance and located at the upstream position stores toner whose margin as to color mixture is smaller than a margin of toner stored in the other developing device located at the downstream position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
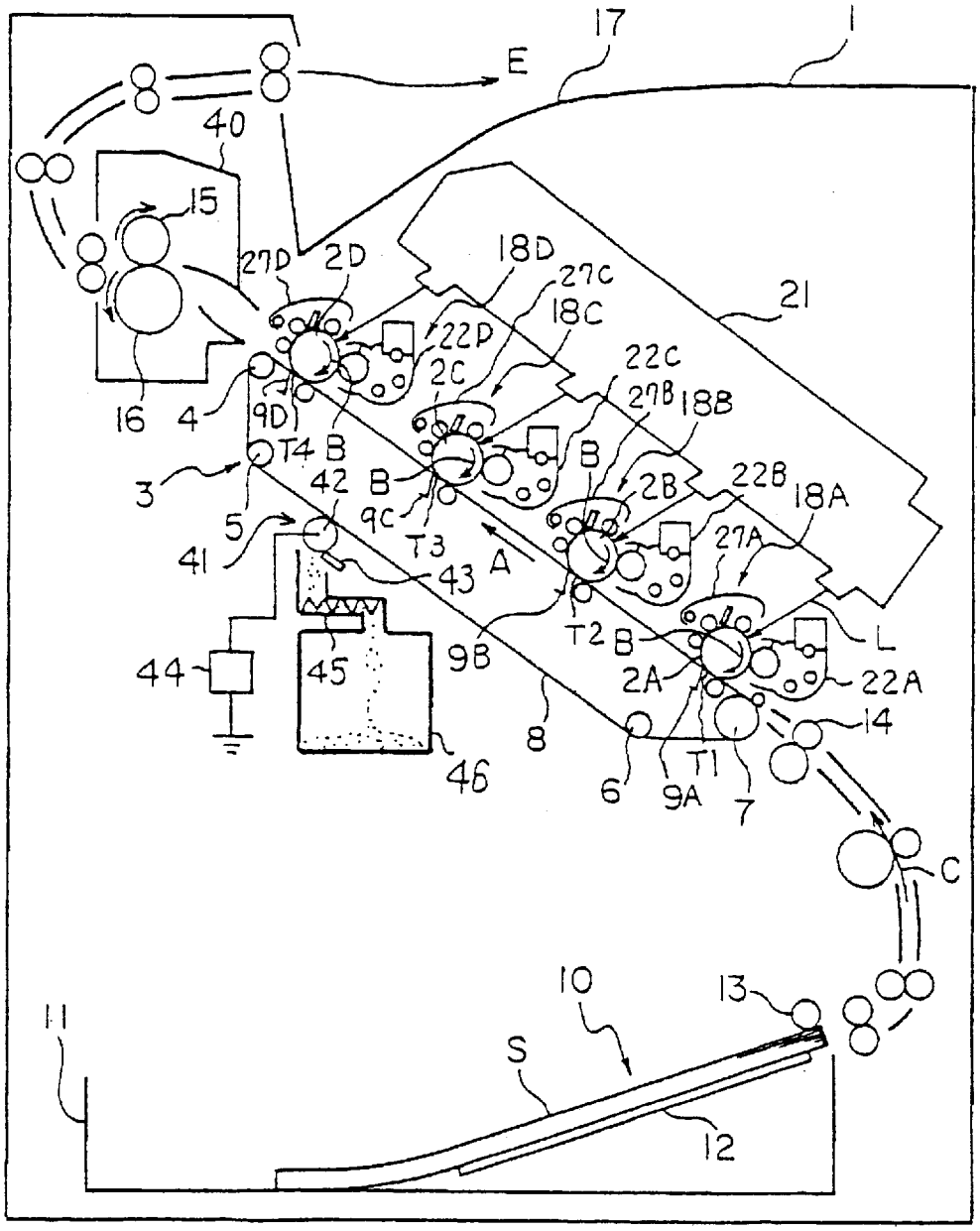
FIG. 1 is a vertical sectional view showing an image forming apparatus embodying the present invention.

Referring to FIG. 1 of the drawings, a tandem image forming apparatus embodying the present invention is shown and includes a casing 1. As shown, the casing 1 accommodates a plurality of (four in the illustrative embodiment) image carriers implemented as photoconductive drums 2A, 2B, 2C and 2D by way of example. The drums 2A through 2D are sequentially arranged in this order in a direction A in which a paper sheet or similar recording medium is conveyed (direction of paper conveyance A hereinafter). A toner image of a first color to a toner image of a fourth color are respectively formed on the first drum 2A positioned at the most upstream side in the above direction to the fourth image drum 2D positioned at the most downstream side. The drums 2A through 2D each are rotatable in a direction indicated by an arrow B in FIG. 1. The colors assigned to the drums 2A through 2D, which are yellow, magenta, cyan and black, will be described specifically later.

A conveyor 3 faces the drums 2A through 2D and includes an endless belt 8 passed over a plurality of support rollers 4 through 7. The support roller 4 is driven to rotate counterclockwise, as viewed in FIG. 1, causing the belt 8 to run in the direction of paper conveyance A. The belt 8 is a specific form of a recording medium carrier for conveying a paper sheet or similar recording medium and may be replaced with, e.g., a drum, if desired.

The drums 2A through 2D contact the surface of the belt 8. Brushes 9A through 9D respectively face the drums 2A through 2D with the intermediary of the belt 8 and are a specific form of image transfer units for transferring toner images from the drums 2A through 2D to a paper sheet. The brushes 9A through 9D may be replaced with any other suitable image transfer units, e.g., rollers, blades or chargers.

A paper feeder 10 is arranged at the bottom of the casing 1 and includes a cassette 11. The cassette 11 has a bottom plate 12 loaded with a stack of recording media S, which may be plain sheets, resin films, resin sheets, cloths or similar flexible materials. Let the recording media S be represented by paper sheets hereinafter. A pickup roller 13 contacts the top paper sheet S and rotates counterclockwise in order to feed it toward a registration roller pair 14 in a direction indicated by an arrow C. The registration roller pair 1 once stops the paper sheet S and then drives it toward the belt 8 at a preselected timing. The belt 8 conveys the paper sheet S in the direction A via image transfer positions T1 through T4 where the drums 2A through 2D, respectively, contact the belt 8.

A toner image of a first color is formed on the surface of the first drum 2A, as stated earlier. A bias for image transfer is applied to the brush 9A and opposite in polarity to a charge deposited on the toner forming the above toner image. Therefore, when the paper sheet S arrives at the image transfer position T1 between the drum 1A and the belt 8, the brush 9A transfers the toner image from the image carrier 2A to the paper sheet S. Subsequently, the paper sheet S is sequentially conveyed via the successive image transfer positions T2, T3 and T4 between the drums 213, 2C and 2D and the belt 8. At this instant, the brushes 9B, 9C and 9D, to which biases for image transfer are also applied, transfer toner images from the drums 2B, 2C and 2D, respectively, to the paper sheet S over the toner image transferred from the drum 2A, thereby completing a full-color toner image on the paper sheet S.

The paper sheet S with the full-color toner image is separated from the belt 8 and then passed through a fixing unit 40. The fixing unit 40 includes a heat roller 15 and a press roller 16 each rotating in a particular direction indicated by an arrow in FIG. 1. The heat roller 15 and press roller 16 fix the full-color toner image on the paper sheet S with heat and pressure. The paper sheet or printing S with the fixed image is driven out of the casing 1 to a tray 17, which is implemented by the top wall of the casing 1.

During the above-described procedure, toner deposits on the belt 8. Should such toner be left on the belt 8, it would be transferred to and smear the paper sheet S. In light of this, a cleaner 41 removes the toner deposited on the belt or recording medium carrier. In the illustrative embodiment, the cleaner 41 includes a cleaning roller 42 rotatable in contact with the belt 8 and a blade 43 pressed against the cleaning roller 42. A power source 44 applies a voltage opposite in polarity to the charge of the toner deposited on the belt 8 to the cleaning roller 42. In this condition, the cleaning roller 42 electrostatically collects the toner from the belt 8 to thereby clean the surface of the belt 8. The blade 43 scrapes off the toner deposited on the cleaning roller 42. The toner scraped off the by blade 43 is collected in a waste toner bottle 46 via a duct 45. If desired, the cleaning roller 42 may be replaced with or combined with, e.g., a cleaning blade or similar cleaning member.

The drums 2A through 2D and elements for forming toner images thereon are implemented as process cartridges 18A through 18D, respectively, which are individually removable from the casing 1. The process cartridges 18A through 18D are identical in basic configuration to each other except for the presence/absence of toner recycling means, which will be described later specifically. Let the following description concentrate on the basic configuration and operation of the process cartridge 18A including the first drum 2A.

Figure 2:
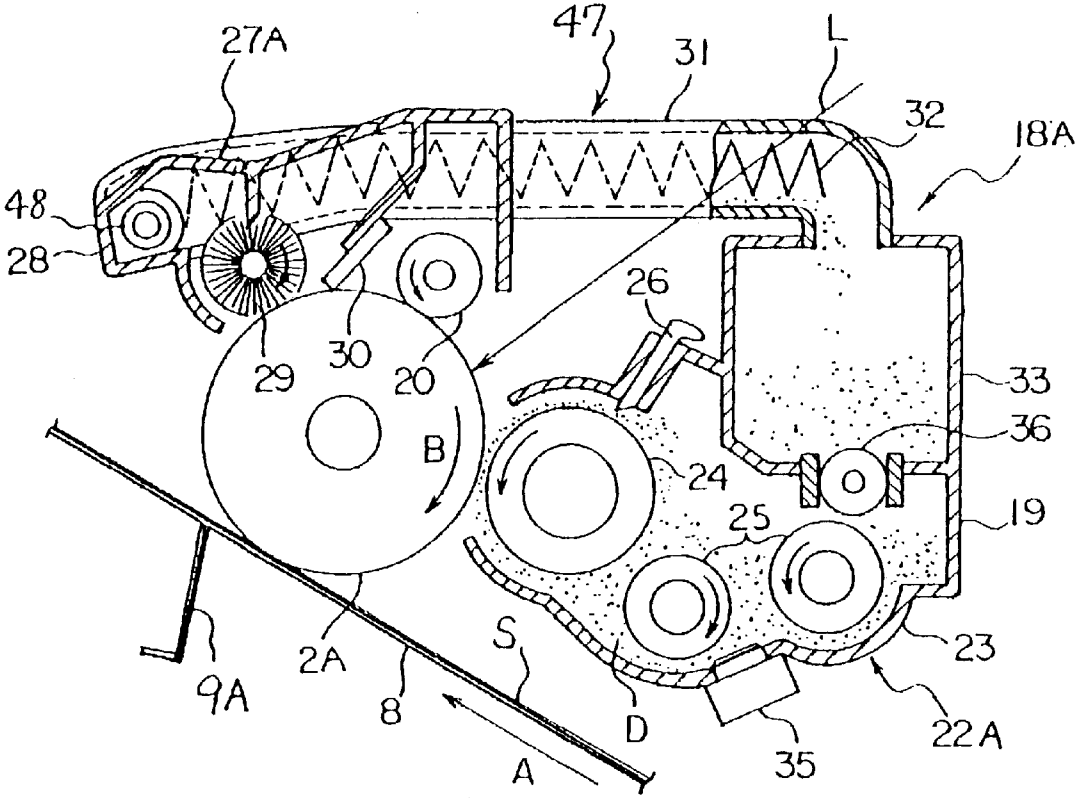
FIG. 2 is a fragmentary enlarged view of the illustrative embodiment.

As shown in FIG. 2 specifically, the process cartridge 18A includes a unit case 19. The drum 2A is rotatably supported by the unit case 19 and driven to rotate by a drive source, not shown, in the direction B. A charge roller or charger 20 is also supported by the unit case 19 and rotatable in contact with the drum 2A in order to uniformly charge the surface of the drum 2A to a preselected polarity, e.g., negative polarity.

As shown in FIG. 1, a laser writing unit or exposing unit 21 is accommodated in the casing 1 together with the process cartridges 18A through 18D. As shown in FIG. 2, a laser beam L issuing from the laser writing unit 21 and modulated in accordance with image data selectively scans the charged surface of the drum 2A, forming a latent image expected to form the toner image of the first color on the drum 2A. In the illustrative embodiment, the surface potential of the drum 2A drops in absolute value in portions scanned by the laser beam L, forming the latent image. The other portions of the drum 2A not scanned by the laser beam L constitute background.

A shown in FIG. 2, a developing device 22A develops the above-stated latent image to thereby form a corresponding toner image of the first color. The developing device 22A includes a development case 23 forming part of the unit case 19 and accommodating a developing roller 24 and an agitating roller 25. The developing roller 24 is supported by the development case 23 and driven to rotate counterclockwise. The agitating roller 25 is also rotatably supported by the development case 23. The development case 23 stores a two-ingredient type developer D, which is a toner and carrier mixture. The two-ingredient type developer may be replaced with a one-ingredient type developer, i.e., toner, if desired.

The agitating roller 25 agitates the developer D so as to frictionally charge the toner and carrier thereof to opposite polarities. For example, the toner and carrier are charged to negative polarity and positive polarity, respectively. The developer D so charged deposits on the developing roller 24 to which a bias identical in polarity with the toner is applied. While the developing roller 24 in rotation conveys the developer D, a doctor blade 26 regulates the amount of the developer D existing on the roller 24. When the developer D reaches a developing position between the developing roller 24 and the drum 2A, the toner of the developer D is electrostatically transferred to the latent image present on the drum 2A for thereby forming the toner image of the first color.

A hopper 33 is formed in the developing device 22A. A toner container, not shown, replenishes fresh toner to the hopper 33 via a toner inlet not shown. A toner content sensor 35 is responsive to the toner content of the developer D stored in the development case 23. When the toner content decreases, as sensed by the sensor 35, a replenishing roller 36 is rotated to replenish the fresh toner from the hopper 33 to the development case 23.

After the transfer of the toner image of the first color from the drum 2A to the paper sheet S, a cleaning device 27A removes the toner left on the surface of the drum 2A. In the specific configuration shown in FIG. 2, the cleaning device 27A includes a cleaning case 28 forming part of the unit case 19, a cleaning brush 29 supported by the cleaning case 28 and rotatable in a direction indicated by an arrow, and a cleaning blade 30 affixed to the cleaning case 28. The cleaning brush 29 and cleaning blade 30 are held in contact with the drum 2A in order to clean the surface of the drum 2A.

The other process cartridges 18B, 18C and 18D are identical in configuration with the process cartridge 18A except for the following. The process cartridges 18B, 18C and 18D respectively include developing devices 22B, 22C and 22D respectively storing toner and carrier mixtures of the second, third and fourth colors. Toner images of the second, third and fourth colors are formed on the drums 2B, 2C and 2D, respectively. Further, the process cartridges 18B, 18C and 18D include cleaning devices 28B, 27C and 27D, respectively. The developing devices 22A through 22D sequentially arranged from the upstream side to the downstream side in the direction of paper conveyance will sometimes be referred to as a first to a fourth developing device, respectively. Likewise, the cleaning devices 27A through 27D arranged in the above direction will be sometimes referred to as a first to a fourth cleaning device.

In the tandem image forming apparatus described above, the drums 2A through 2D each may be replaced with an endless belt passed over a plurality of rollers. The four drums or image carriers 2A through 2D may be replaced with, e.g., two, three, five or more drums, if necessary. The crux is that the apparatus includes at least two image carriers arranged in the direction of paper conveyance, developing devices each for forming a toner image of particular color on one of the image carriers, and cleaning devices each for cleaning the surface of one of the image carriers after image transfer.

Further, the apparatus shown in FIG. 1 includes the recording medium carrier for conveying the paper sheet S and the cleaner for cleaning the recording medium carrier.

By applying the previously mentioned toner recycling system to the tandem image forming apparatus, it is possible to reduce toner consumption and therefore to promote the efficient use of limited resources. A specific configuration of the toner recycling system will be described with reference to FIG. 2. As shown, the process cartridge 18A includes a toner recycling device 47. The toner recycling device 47 is made up of the cleaning case 28 of the cleaning device 27A, a return duct 31 providing fluid communication between the cleaning case 28 and the hopper 33 of the developing device 22A, and a screw or toner conveying member 32 disposed in the return duct 31.

A screw 48 is positioned in the cleaning case 28 and driven to rotate. The screw 48 conveys the toner removed from the image carrier 2A by the cleaning brush 29 and cleaning blade 30 to the return duct 31. Then, the screw 32 being rotated by a drive source, not shown, conveys or returns the toner via the return duct 31 to the hopper 33. The replenishing roller 36 in rotation feeds the toner, which is returned from the cleaning case 28 tothe hopper 33, and the previously mentioned fresh toner to the developer D existing in the development case 23. The returned toner is therefore again used to develop a latent image formed on the drum 2A. In this manner, the toner recycling device 47 returns the toner collected from the image carrier 2A by the cleaning device to the developing device assigned to the drum 2A.

The toner recycling device 47 may be arranged between all of the cleaning devices 27A through 27D and all of the developing devices 22A through 22D associated therewith. Alternatively, the toner recycling device 47 may be arranged between part of the cleaning devices 27A through 27D and part of the developing devices 22A through 22D. However, when the toner recycling device 47 exists between the cleaning device and the developing device other than those assigned to the first drum 2A, the device 47 is apt to cause toner of different colors to be mixed in the developing device.

For example, assume that the toner recycling device is arranged between the cleaning device 27D and the developing device 22D assigned to the fourth drum 2D. Then, when the toner image of the fourth color is transferred from the drum 2D to the paper sheet S, the toner of the first color, the second color, and the third color existing on the paper sheet S are transferred to the fourth drum 2D. The fourth cleaning device 27D collects such toner together with the toner of the fourth color left on the drum 2D. The recycling device returns the mixture of toner of different colors to the fourth developing device 22D. The resulting toner image formed by the developing device 22D is slightly different from the expected fourth color, degrading color reproducibility as to the full-color image transferred to the paper sheet S.

Figure 3:
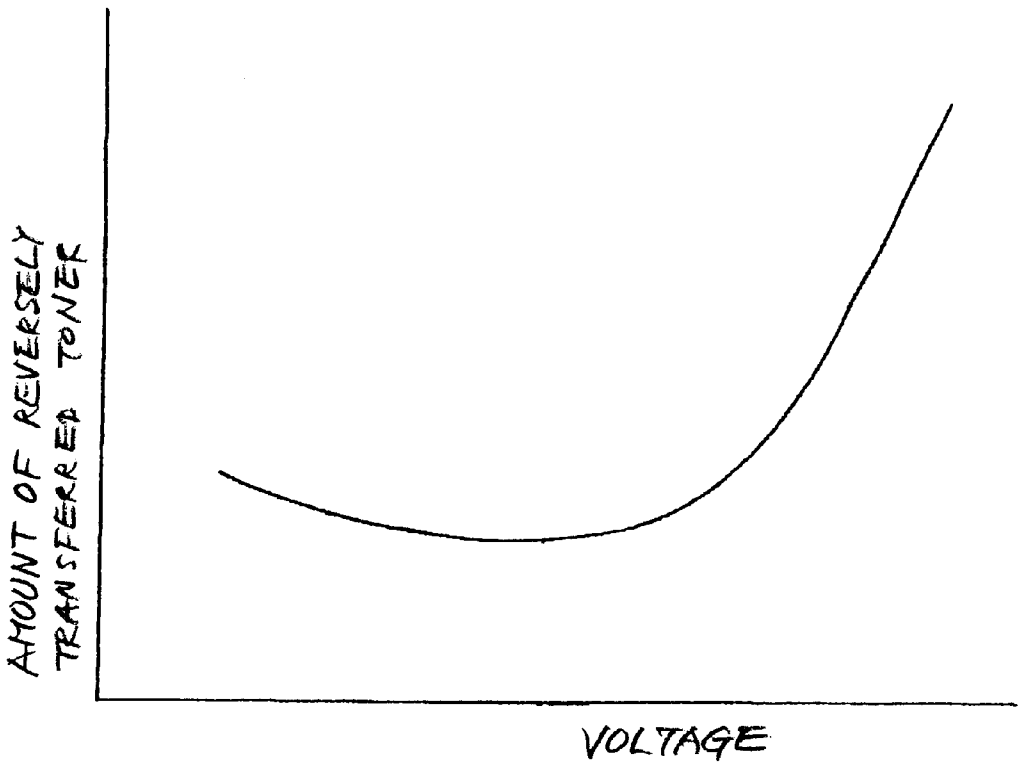
FIG. 3 is a graph showing a relation between a bias voltage for image transfer and the amount of toner reversely transferred.

The transfer of the toner from the paper sheet S to the image carrier and such toner will be referred to as reverse transfer and reversely transferred toner, respectively. We conducted a series of experiments in order to determine a relation between the image transfer condition, e.g., the voltage applied to the image transfer unit for forming an electric field and the reverse transfer. FIG. 3 shows the experimentally determined relation. As shown, although a condition that minimizes the reversely transferred toner is available, a condition that reduces it to zero is not available. This suggests that the toner is reversely transferred to the drum by forces other than an electrostatic force. Because such forces are usually not control lable, the reversely transferred toner cannot be obviated.

In light of the above, we further conducted experiments by arranging the toner recycling device 47 between all of the cleaning devices 27A through 27D and the associated developing devices 22A through 22D. The experiments showed that the mixture of toner of different colors occurred as will be described hereinafter.

The toner recycling device 47 between the cleaning device 27A and the developing device 22A does not bring about the mixture of toner because no drums or image carriers exist upstream of the drum 27A. The first cleaning device 27A simply removes the toner of the first color from the drum 2A. On the other hand, when the paper sheet S carrying the toner image of the first color arrives at the second drum 2B, the toner of the first color is transferred to the drum 2B. The amount of toner reversely transferred to the second drum 2B through the fourth drum 2D sequentially increases because toner images of different colors are sequentially transferred to the paper sheet one above the other. Consequently, the mixture of toner of different colors is most noticeable in the fourth developing device 22D. In this manner, the mixture of toner of different colors is apt to occur more in the downstream developing device than in the upstream developing device.

More specifically, only toner of the first color exists in the first cleaning device 27A while the mixture of toner of the first and second colors exist in the second cleaning device 27B. Further, toner of the first to third colors exist in the third cleaning device 27C while toner of the first to fourth colors exist in the fourth cleaning device 27D. That is, assuming the N-th cleaning device in the direction of paper conveyance, then toner deposited on the N-th image carrier and toner deposited on the image carrier or carriers upstream of the N-th image carrier exist together. This is also true when the number of image carriers is other than four.

The illustrative embodiment arranges, based on the above finding, the toner recycling device 47 between the cleaning device, which removes toner from the image carrier located at the most upstream side in the direction of paper conveyance, and the developing device associated therewith. However, the illustrative embodiment does not provide the toner recycling device 47 between the cleaning device, which removes toner from the image carrier located at the most downstream side in the above direction, and the developing device associated therewith. This configuration is applicable to any image forming apparatus so long as it includes at least two image carriers. As for an image forming apparatus including three or more image carriers, as in the illustrative embodiment, the toner recycling device 47 may or may not be arranged between the cleaning devices and the developing devices between the most upstream ones and the most downstream ones. A first to a third more specific configuration will be described hereinafter.

In the first configuration, the toner recycling device 47 is arranged between each of the cleaning devices 27A through 27C and each of the developing devices 22A through 22C, but is not arranged between the cleaning device 27D and the developing device 22D. This configuration obviates color mixture, which would be most noticeable in the developing device 22D if the toner recycling device 47 were provided between all of the cleaning devices and all of the developing devices. It is therefore possible to protect images from the degradation of color reproducibility more effectively.

The second configuration is identical with the first configuration except that the tone recycling device 47 between the cleaning device 27C and the developing device 22C is absent. This configuration obviates color mixture more noticeable in the developing device 22C and most noticeable in the developing device 22D if the toner recycling device 47 were provided between all of the cleaning devices and all of the developing devices. It is therefore possible to protect images from the degradation of color reproducibility more effectively.

The third configuration is identical with the second configuration except that the tone recycling device 47 between the cleaning device 27B and the developing device 22B is absent. That is, in the third configuration, the toner recycling device 47 is arranged only between the cleaning device 27A and the developing device 22A. This configuration obviates color mixture in the developing device 22B also and protects images from the degradation of color reproducibility much more effectively.

In any one of the first to third configurations, the toner recycling device 47 is provided between the first cleaning device 27A and the first developing device 22A and reduces toner consumption. This toner recycling device 47 does not bring about color mixture in the developing device 22A, as stated earlier.

One of the developing devices, to which toner is returned, located at the most downstream position in the direction of paper transfer should preferably store black toner. Such a developing device, in which color mixture is apt to occur more than in the others, forms a black toner image on the associated image carrier. For example, in the first configuration described above, the third developing device 22C located more downstream than the first and second developing devices 22A and 22B stores black toner so as to form a black toner image on the image carrier 2B. In the second configuration, the second developing device 22B located more downstream than the first developing device 22A stores black toner so as to form a black toner image on the image carrier 2B. While the other three developing devices each are assigned to one of yellow, magenta and cyan, the colors to be assigned to the three developing devices are open to choice.

The mixture of toner of different colors is most conspicuous when magenta, cyan or black toner is introduced in yellow toner, causing the tint of yellow toner to noticeably vary. By contrast, the mixture of such toner with black toner does not noticeably change the tint of the black toner. This is why the developing device in which color mixture is apt to occur more than in the other developing devices is caused to form a black toner image on the associated image carrier. Even when color mixture occurs in such a developing device, the tint of a black toner formed on the image carrier therefore changes little. This successfully prevents the color reproducibility of a full-color toner image from being degraded.

An alternative arrangement available with the previously stated basic construction is as follows. The toner recycling device is provided between one of the cleaning devices for removing residual toner from the image carrier, which is located at the most upstream side in the direction of paper transfer, and the developing device for forming a toner image on the same image carrier. The toner recycling device is also provided between the cleaning device for removing residual toner from at least one of the other image carriers and the developing device for forming a toner image on the above image carrier. Black toner is stored in the most downstream one of the developing devices to which toner is returned via the toner recycling devices. This alternative arrangement is also applicable to an image forming apparatus including image carriers the number of which is other than four.

More specifically, in the construction shown in FIG. 1, the toner recycling device 47 is provided between the first cleaning device 27A and the first developing device 22A and between at least one of the second to third cleaning devices 27B through 27D and at least one of the second to third developing devices 22B through 22D. The most downstream one of the developing devices, to which toner is returned via the associated toner recycling devices 47, is assigned to development in black. For example, when the toner recycling device 47 is provided between all of the cleaning devices 27A through 27D and all of the developing devices 22A through 22D, the developing device 22D located at the most downstream position is assigned to development in black. In this case, too, the developing device, in which color mixture is apt to occur more than in the other developing devices, forms a black toner image with a minimum of tint variation ascribable to color mixture, insuring desirable color reproducibility. In addition, the toner recycling devices 47 existing between at least two cleaning devices and at least two developing devices associated therewith reduce toner consumption effectively.

In any one of the specific configurations stated earlier, the developing device for forming a toner image on the image carrier located at the most upstream side should preferably store yellow toner. Specifically, yellow toner is replenished from the hopper 33 of the first developing device 22A to the development case 23, so that the developing device 22A can form a yellow toner image on the image carrier 2A. That is, yellow toner whose tint changes more than the other toner is stored in the developing device 22A, which is free from color mixture despite the return of residual toner from the toner recycling device 47. This successfully prevents the degradation of color reproducibility effectively. This kind of scheme is applicable to any one of the specific configurations stated earlier.

Alternatively, yellow toner may be stored in the developing device to which residual toner is not returned by the toner recycling device. For example, in the first specific configuration, yellow toner is stored in the fourth developing device 22D because the toner recycling device is absent between the developing device 22D and the associated cleaning device 27D. Likewise, in the second specific configuration, yellow toner is stored in either one of the third and fourth developing devices 22C and 22D because the toner recycling device is absent between the developing devices 22C and 22D and the associated cleaning devices 27C and 27D. This also prevents yellow toner from being mixed with toner of the other colors and thereby insures desirable color reproducibility. The other colors to be assigned to the other developing devices are open to choice. This kind of scheme is also applicable to any one of the specific configurations stated earlier.

The toner recycling device arranged between the cleaning device and the developing device brings about the mixture of toner of different colors in the developing device, as stated earlier. In this case, assume that part of the mixed toner is discharged to the outside of the developing device, and that fresh toner free from color mixture is replenished to the development case 23 of the developing device. Then, it is possible to reduce the color mixture in the above developing device and therefore to noticeably reduce or practically obviate the change of tint of a toner image to be formed by the developing device. This mode that discharges part of the mixed toner will be referred to as a mixed toner consumption mode hereinafter.

To execute the mixed toner consumption mode, assume that the toner recycling device 47 is arranged between the second cleaning device 27B and the second developing device 22B. Because the second process cartridge 18B accommodating the cleaning device 27B and developing device 22B is identical in configuration with the first process cartridge 18A, the operation of the process cartridge 18B will be described with reference to FIG. 2.

At a time other than the time for transferring a toner image from the drum 2B to the paper sheet S, i.e., when image formation is not under way, the drum 2B is uniformly charged by the charge roller 20 while being rotated in the direction B. The writing unit 21, shown in FIG. 1, scans the entire charged surface of the drum 2B or part thereof with the laser beam L. The developing unit 22B then causes toner to electrostatically deposit on the scanned surface of the drum 2B. The charging step of the drum 2B may be omitted, if desired. Subsequently, a voltage opposite in polarity to the charge of the toner is applied to the brush 9B, as illustrated in FIG. 1, so as to transfer the toner from the drum 2B to the belt 8 running in the direction A. At this instant, a voltage opposite in polarity to the charge of the toner transferred to the belt 8 is applied to the cleaning roller 42 of the cleaner 41, shown in FIG. 1. In this condition, the toner is electrostatically transferred from the belt 8 to the cleaning roller 42, so that the surface of the belt 8 is cleaned. The toner collected by the cleaning roller 42 is removed by the blade 43 and then conveyed to the waste toner bottle 46 via the duct 45, as stated previously. A controller, not shown, executes such a mixed toner consumption mode.

By the mixed toner consumption mode, part of the mixed toner is discharged from the development case 23 of the developing device 22B and then collected in the waste toner bottle 46. At the same time, fresh toner is replenished from a toner container, not shown, to the development case 23 via the hopper 33 complementarily in amount to the mixed toner discharged. In this manner, the mixed toner consumption mode allows the developing unit 22B to form a toner image with a minimum of or no tint variation on the image carrier 2B, insuring desirable color reproducibility.

While the mixed toner consumption mode may be executed after every image formation, it would increase the amount of toner to be collected in the waste toner bottle 46 if so done and would thereby make the toner recycling device meaningless. In light of this, the mixed toner consumption mode should preferably be effected every time image forming is repeated a preselected number of times, e.g., once for 100, 500, 700 or 1,000 times of image formation. The mixed toner consumption mode discharges, e.g., about one-half or one-third of the toner existing in the development case each time.

The mixed toner consumption mode is applied to all of the developing devices provided with the toner recycling device other than the most upstream developing device 22A. Effecting this mode with the developing device 22A is senseless because the mixture of toner does not occur in the device 22A at all.

The procedure described above is applicable to a broad range of image forming apparatuses including at least two image carriers and at least one toner recycling device. Specifically, in an image forming apparatus having the recording medium carrier and cleaner in addition to the previously stated basic construction, the toner recycling device is provided between at least one cleaning device and the associated developing device that forms a toner image on an image carrier from which the cleaning device removes residual toner. A controller executes the mixed toner consumption mode such that a developing device other than the most upstream developing device and provided with the toner recycling device deposits toner on the associated image carrier, then the toner is transferred from the image carrier to the recording medium carrier, and then the cleaner removes the toner from the recording medium carrier.

The mixture of toner of different colors is apt to occur more in a downstream developing device than in a downstream developing device other than the most upstream developing device, a stated earlier. Therefore, when the mixed toner consumption mode is effected with at least two developing devices every time image formation is repeated a certain number of times, the mode should preferably be effected more frequently with a downstream developing device than with an upstream developing device.

For example, assume that the toner recycling device 47 is provided between all of the cleaning devices 27A through 27D, represented in FIG. 1, and all of the developing devices 22A through 22D. Then, the mixed toner consumption mode may be effected with the second developing device 22B once for 1,000 times of image formation; toner is discharged from the development case of the developing device 22B to the belt 8 via the drum 2B. The same mode may be effected with the third developing device 22C once for 700 times of image formation, toner is discharged from the development case of the developing device 22C to the belt 8 via the drum 2C. Further, the above mode may be effected with the fourth developing device 22D once for 500 times of image formation; toner is discharged from the development case of the developing device 22C to the belt 8 via the drum 2D. This is successful to effectively protect the color reproducibility of a toner image transferred to the paper sheet S from degradation, and in addition obviates wasteful toner consumption.

The mixture of toner of different colors is most conspicuous as to tint when magenta, cyan or black toner is introduced in yellow toner while it is not conspicuous when such toner is introduced in black toner, as stated previously. This characteristic may be represented by a margin as to color mixture. More specifically, when toner of a first color is mixed with toner of a second color, the margin as to color mixture refers to the size of a color difference between the second color and the mixed color of the latter toner. A large color difference means a small margin as to color mixture. A color difference refers to a distance between two perceivable colors in a color space, as well known in the art. The margin sequentially increases from ye low toner to black toner via magenta toner and cyan toner. The results of a series of experiments will be described with reference to FIGS. 4 through 6.

Figure 4:
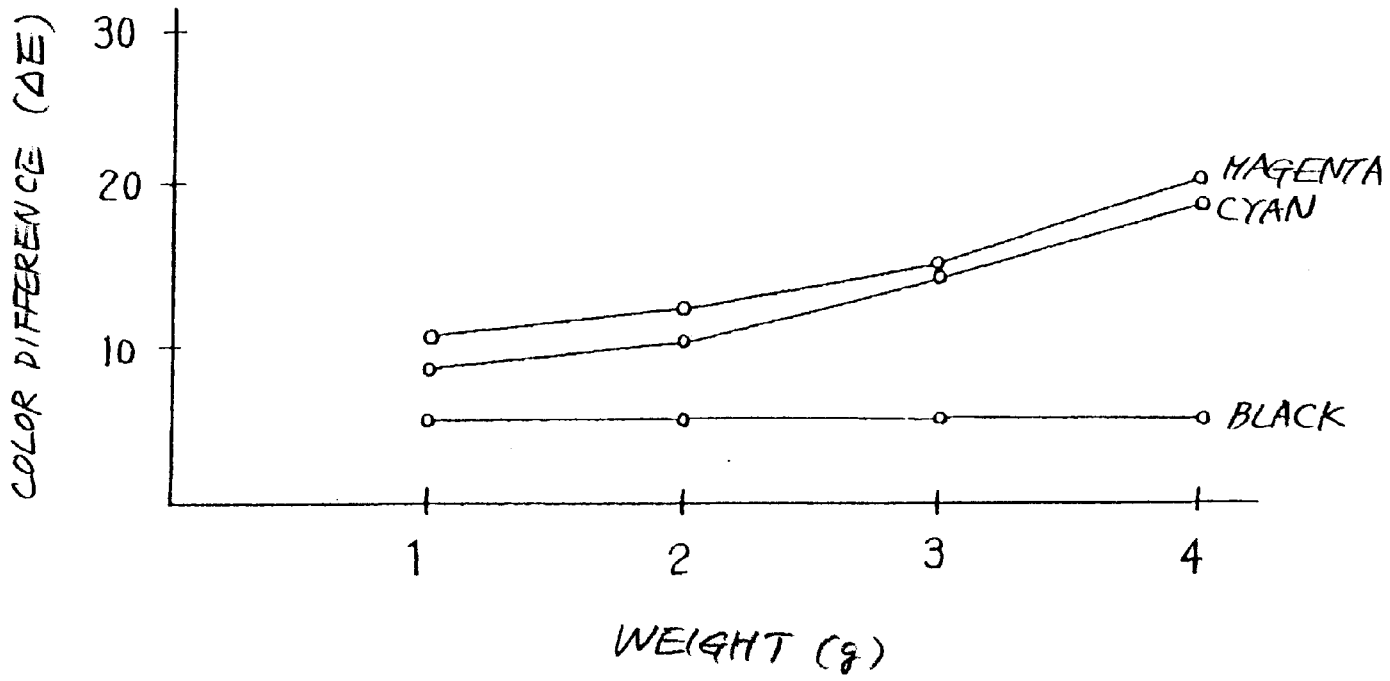
FIGS. 4 through 6 are graphs showing the margins toner of different colors as to color mixture.

As for FIG. 4, 380 grams of two-ingredient developers respectively containing magenta toner, cyan toner and black toner each were stored in a particular developing unit and used to form a respective toner image on a paper sheet. Subsequently, yellow toner was sequentially introduced in the individual developer in the amounts of 1 gram, 2 grams, 3 grams and 4 grams. FIG. 4 shows color differences ΔE between the toner images formed by the developers without the yellow toner and the toner images formed by the developers with the yellow toner. As shown, the color difference of the black toner changes little without regard to the content of the yellow toner while the color differences of the cyan toner and magenta toner change in substantially the same manner as each other.

Figure 5:
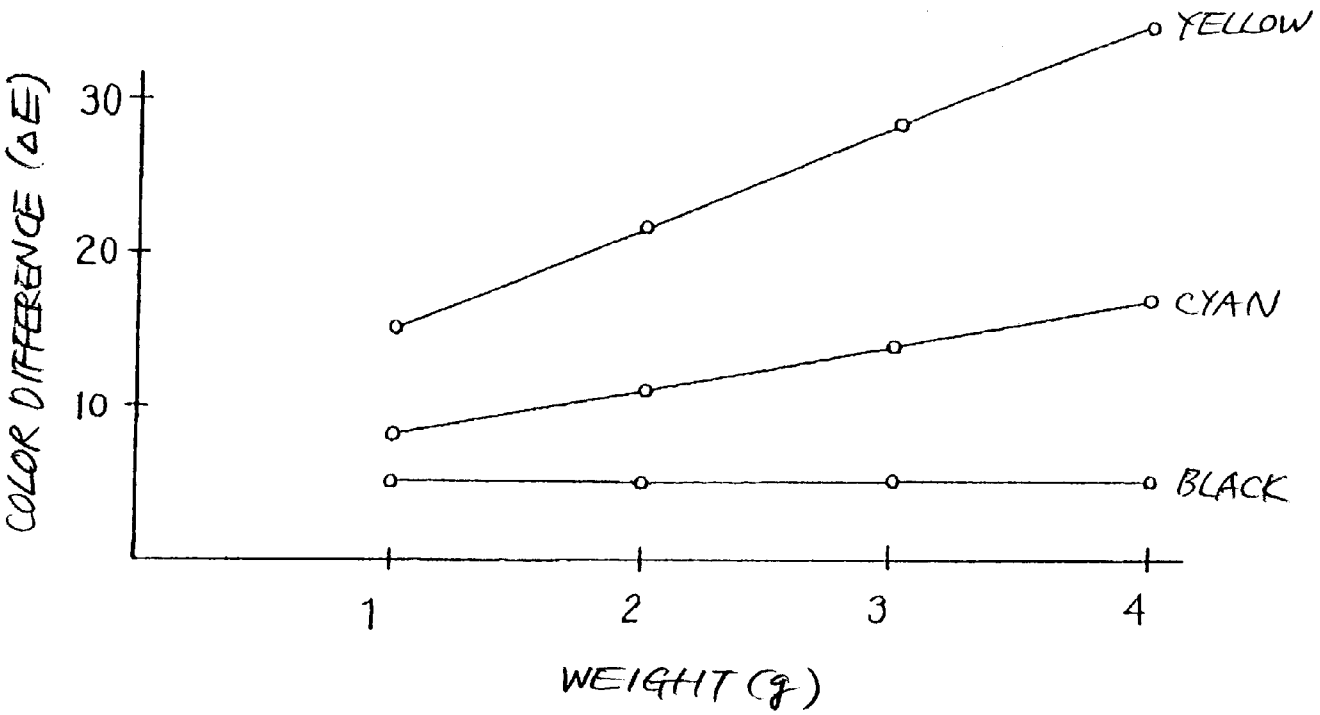

As for FIG. 5, 380 grams of two-ingredient developers respectively containing yellow toner, cyan toner and black toner were stored in a particular developing unit and used to form a respective toner image on a paper sheet. Subsequently, magenta toner was sequentially introduced in the individual developer in amounts of 1 gram, 2 grams, 3 grams and 4 grams. FIG. 5 shows color differences ΔE between the toner images formed by the developers without the magenta toner and the toner images formed by the developers with the magenta toner. As shown, the color difference of the black toner changes little without regard to the content of the yellow toner, as in FIG. 4. However, the color difference of the yellow toner noticeably changes as the content of the magenta toner increases. The variation of the color difference of the cyan toner is almost between the variation of the yellow toner and that of the black toner.

Figure 6:
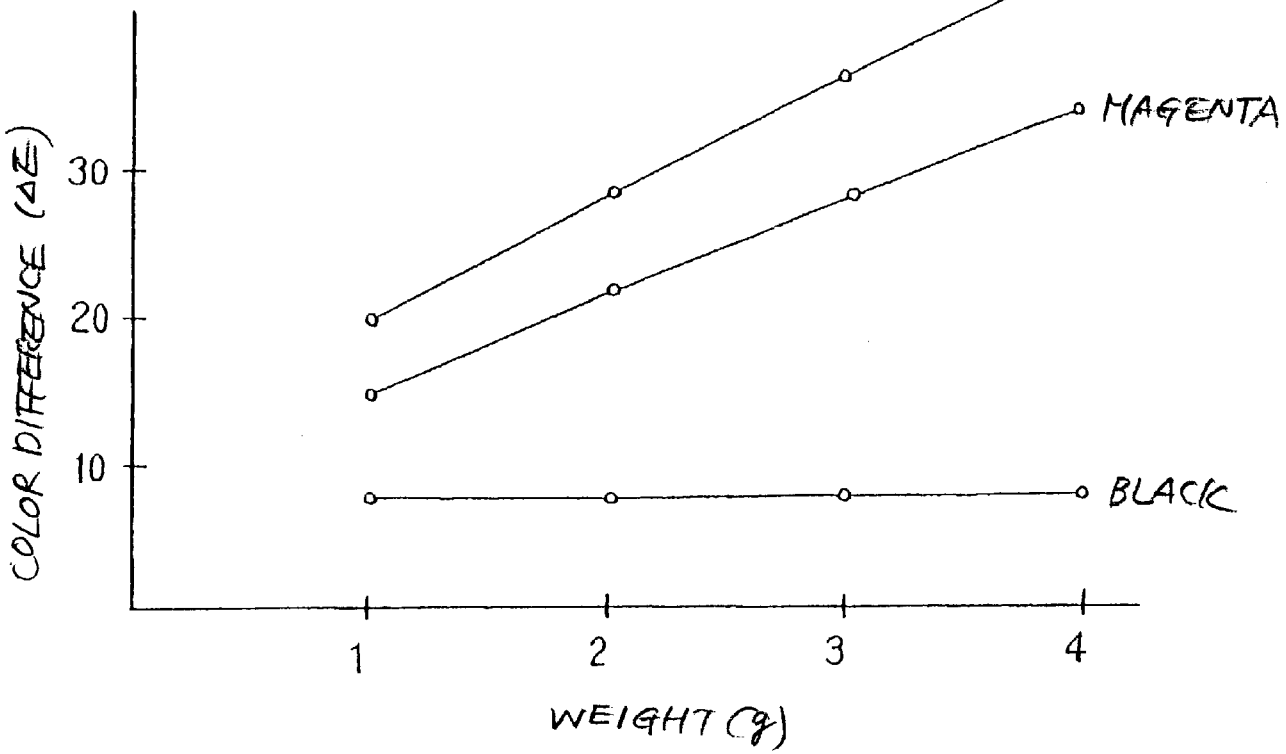

As for FIG. 6, 380 grams of two-ingredient developers respectively containing ye low toner, magenta toner and black toner were stored in a particular developing unit and used to form a respective toner image on a paper sheet. Subsequently, cyan toner was sequentially introduced in the individual developer in amounts of 1 gram, 2 grams, 3 grams and 4 grams. FIG. 5 shows color differences ΔE between the toner images formed by the developers without the cyan toner and the toner images formed by the developers with the cyan toner. As shown, the color difference of the black toner changes little without regard to the content of the cyan toner, as in FIGS. 4 and 5. However, the color difference of the ye low toner is as great as or even greater than the difference shown in FIGS. 4 and 5. Although the color difference of the magenta toner is not as great as the color difference of the yellow toner, it still increases with an increase in the content of the cyan toner and changes more noticeably than the cyan toner shown in FIG. 5.

As FIGS. 4 through 6 indicate, the margin as to color mixture sequentially increases from yellow toner to the black toner via the magenta toner and cyan toner. Stated another way, yellow toner changes in tint more sharply than the other toner when toner of different color is introduced therein.

Assume that the toner recycling device 47 is provided between all of the cleaning devices 27A through 27D and all of the developing devices 22A through 22D corresponding thereto. Then, the influence of the mixture of toner can be minimized if yellow toner, magenta toner, cyan toner and black toner are respectively stored in the developing devices 22A, 22B, 22C and 22D, for the following reasons (1) through (4).

(1) The developing device 22A is free from the mixture of toner. The developing device 22A therefore does not degrade color reproducibility even if it forms a yellow toner image whose margin as to color mixture is smallest.

(2) Although the mixture of toner is most noticeable in the developing device 22D, the developing device 22D protects color reproducibility from degradation because it forms a black toner image whose margin as to color mixture is greatest.

(3) Because the mixture of toner in the developing device 228 is not noticeable, the developing unit 22B also protects color reproducibility from degradation despite the magenta toner whose margin as to color mixture is not so great.

(4) The developing device 22C, in which the mixture of toner is relatively noticeable, protects color reproducibility from degradation because it forms a cyan toner image whose margin as to color mixture is relatively great.

As stated above, it is possible to minimize the degradation of color reproducibility of a full-color image on a paper sheet while reusing residual toner collected from all of the drums 2A through 2D.

The above-described concept is similarly applicable even to an image forming apparatus of the type forming toner images on image carriers with red, green, blue and black toner or of the type using two or three of such toner of different colors. The margin as to color mixture sequentially increases from red to black via green and blue.

It will be seen that the construction described above is applicable to an image forming apparatus using any suitable of combination of colors. The crux is that in the basic construction stated earlier, the toner recycling device is provided between each cleaning device and each developing device associated therewith, and that upstream one of developing devices adjoining each other in the direction of paper transfer stores toner smaller in margin as to color mixture than toner stored in the downstream developing device.

The present invention is applicable to various kinds of image forming apparatuses including a printer. The various specific configurations shown and described may be combined to implement an image forming apparatus, if desired.

In summary, it will be seen that the present invention provides an image forming apparatus having various unprecedented advantages, as enumerated below.

(1) A toner recycling device reduces toner consumption. Because the toner recycling device is not provided between the most downstream cleaning device and a developing device associated therewith, the color reproducibility of an image is protected from degradation ascribable to the mixture of different colors.

(2) A developing device, in which color mixture is most likely to occur, forms a black toner image whose tint shows the least change ascribable to color mixture. This reduces the degradation of color reproducibility ascribable to color mixture more effectively.

(3) A developing device, in which color mixture does not occur, forms a yellow toner image whose tint noticeably changes due to color mixture. This also reduces the degradation of color reproducibility ascribable to color mixture more effectively.

(4) Toner of a different color is prevented from being mixed with yellow toner whose tint noticeably changes due to color mixture. Because yellow toner forms a toner image on an image carrier, the degradation of color reproducibility ascribable to color mixture can be reduced more effectively.

(5) Toner mixed together in a developing device can be at least partly discharged from the developing device in a mixed toner consumption mode. This also reduces the degradation of color reproducibility ascribable to color mixture more effectively.

(6) The mixed toner consumption mode can be executed without causing an excessive amount of toner to be consumed.

(7) The amount of waste toner can be minimized. In addition, even when color mixture occurs in a developing device, there can be effectively reduced the degradation of color reproducibility ascribable to color mixture.

Various modifications will become possible for those skilled in the art after receiving the teachings of the present disclosure without departing from the scope thereof.

What is claimed is:

1. An image forming apparatus comprising:

at least two image carriers sequentially arranged in a direction of conveyance in which a recording medium is conveyed;

developing means each for forming a toner image of a particular color on one of said image carriers;

cleaning means each for removing residual toner left on a surface of one of said image carriers after a transfer of the toner image to the recording medium;

toner recycling means each for returning the residual toner removed from any one of said image carriers by one of said cleaning means associated with said image carrier to one of said developing means that forms the toner image on said one image carrier, wherein said toner recycling means is present between one of said cleaning means, which removes the residual toner from an associated one of said image carriers located at a most upstream position in the direction of conveyance, and one of said developing means assigned to said one image carrier, but is absent between another cleaning means, which removes the residual toner from another image carrier located at a most downstream position in said direction of conveyance, and another developing means assigned to said another image carrier; and control means for controlling, at a time other than a time for transferring toner images from said image carriers to the recording medium, a mixed toner consumption mode which causes any one of said developing means other than said developing means located at a most upstream position in the direction of conveyance to deposit the toner on an associated one of said image carriers, transfer a toner to a recording medium carrier, and causes said cleaner to remove said toner from said recording medium carrier.

2. An apparatus as claimed in claim 1, wherein one of said developing means, to which said toner recycling means return the residual toner, located at the most downstream position stores black toner for forming a black toner image.

3. An apparatus as claimed in claim 2, wherein one of said developing means, which is assigned to said image carrier located at the most upstream position, stores yellow toner for forming a yellow toner image.

4. An apparatus as claimed in claim 2, wherein said developing means to which the residual toner is not returned by said toner recycling means stores yellow toner for forming a yellow toner image.

5. An apparatus as claimed in claim 1, wherein one of said developing means, which is assigned to said image carrier located at the most upstream position, stores yellow toner for forming a yellow toner image.

6. An apparatus as claimed in claim 1, wherein said developing means to which the residual toner is not returned by said toner recycling means stores yellow toner for forming a yellow toner image.

7. An image forming apparatus comprising:

at least two image carriers sequentially arranged in a direction of conveyance in which a recording medium is conveyed;

developing means each for forming a toner image of a particular color on one of said image carriers;

cleaning means each for removing residual toner left on a surface of one of said image carriers after a transfer of the toner image to the recording medium;

toner recycling means each for returning the residual toner removed from any one of said image carriers by said cleaning means associated with said image carrier to one of said developing means that forms the toner image on said one image carrier, wherein said toner recycling means is present between one of said cleaning means, which removes the residual toner from an associated one of said image carriers located at a most upstream position in the direction of conveyance, and one of said developing means associated with said one image carrier and between another cleaning means, which removes the residual toner from at least one image carrier other than said image carrier located at the most upstream position, and another developing means associated with said at least one image carrier, and wherein one of said developing means, to which the residual toner is returned by said toner recycling means, located at the most downstream position stores black toner for forming a black toner image; and control means for controlling, at a time other than a time for transferring toner images from said image carriers to the recording medium, a mixed toner consumption mode which causes any one of said developing means other than said developing means located at a most upstream position in the direction of conveyance to deposit the toner on an associated one of said image carriers, transfer said toner to a recording medium carrier, and causes said cleaner to remove said toner from said recording medium carrier.

8. An apparatus as claimed in claim 7, wherein one of said developing means, which is assigned to said image carrier located at the most upstream position, stores yellow toner for forming a yellow toner image.

9. An apparatus as claimed in claim 7, wherein said developing means to which the residual toner is not returned by said toner recycling means stores yellow toner for forming a yellow toner image.

10. An image forming apparatus comprising:

at least two image carriers sequentially arranged in a direction of conveyance in which a recording medium is conveyed;

developing means each for forming a toner image of a particular color on one of said image carriers;

a recording medium carrier for conveying the recording medium;

cleaning means each for removing residual toner left on a surface of one of said image carriers after a transfer of the toner image to the recording medium;

a cleaner for removing toner deposited on said recording medium carrier;

toner recycling means provided between at least one of said cleaning means and one developing means associated with said at least one cleaning means for returning the residual toner removed from one image carrier by said at least one cleaning means to said one developing means; and control means for controlling, at a time other than a time for transferring toner images from said image carriers to the recording medium, a mixed toner consumption mode which causes any one of said developing means other than said developing means located at a most upstream position in the direction of conveyance to deposit the toner on an associated one of said image carriers, transfer said toner to said recording medium carrier, and causes said cleaner to remove said toner from said recording medium carrier.

11. An apparatus as claimed in claim 10, wherein said mixed toner consumption mode is executed with at least two developing means every time an image forming operation is repeated a preselected number of times, and wherein said mixed toner consumption mode is executed more frequently with one developing means located at a downstream position in direction of conveyance than another developing means located at an upstream position in said direction.

12. An image forming apparatus comprising:

at least two image carriers sequentially arranged in a direction of conveyance in which a recording medium is conveyed;

developing means each for forming a toner image of a particular color on one of said image carriers;

cleaning means each for removing residual toner left on a surface of one of said image carriers after a transfer of the toner image to the recording medium;

toner recycling means each for returning the residual toner removed from one of said image carriers by said cleaning means assigned to said image carrier to one of said developing means that forms the toner image on said image carrier, wherein said toner recycling means each are provided between one of said cleaning means and one developing means assigned to one image carrier, from which said one cleaning means removes the residual toner, and wherein one of two developing means adjoining each other in the direction of conveyance and located at an upstream position in said direction stores toner whose margin as to color mixture is smaller than a margin of toner stored in the other developing means located at a downstream position in said direction; and control means for controlling, at a time other than a time for transferring toner images from said image carriers to the recording medium, a mixed toner consumption mode which causes any one of said developing means other than said developing means located at a most upstream position in the direction of conveyance to deposit the toner on an associated one of said image carriers, transfer said toner to a recording medium carrier, and causes said cleaner to remove said toner from said recording medium carrier.

13. An image forming apparatus comprising:

at least two image carriers sequentially arranged in a direction of conveyance in which a recording medium is conveyed;

developing devices each constructed to form a toner image of a particular color on one of said image carriers;

cleaning devices each constructed to remove residual toner left on a surface of one of said image carriers after a transfer of the toner image to the recording medium;

toner recycling devices each constructed to return the residual toner removed from any one of said image carriers by said cleaning device assigned to said image carrier to one of said developing devices that forms the toner image on said image carrier, wherein said toner recycling device is present between one of said cleaning devices, which removes the residual toner from an associated one of said image carriers located at a most upstream position in the direction of conveyance, and one of said developing devices assigned to said one image carrier, but is absent between another cleaning device, which removes the residual toner from another image carrier located at a most downstream position in said direction, and another developing device assigned to said another image carrier; and a controller constructed to control, at a time other than a time for transferring toner images from said image carriers to the recording medium, a mixed toner consumption mode which causes any one of said developing devices other than said developing device located at a most upstream position in the direction of conveyance to deposit the toner on an associated one of said image carriers, transfer said toner to a recording medium carrier, and causes said cleaner to remove said toner from said recording medium carrier.

14. An apparatus as claimed in claim 13, wherein one of said developing devices, to which said toner recycling devices return the residual toner, located at the most downstream position stores black toner for forming a black toner image.

15. An apparatus as claimed in claim 14, wherein one of said developing devices, which is assigned to said image carrier located at the most upstream position, stores yellow toner for forming a yellow toner image.

16. An apparatus as claimed in claim 14, wherein said developing device to which the residual toner is not returned by said toner recycling device stores ye low toner for forming a yellow toner image.

17. An apparatus as claimed in claim 13, wherein one of said developing devices, which is assigned to said image carrier located at the most upstream position, stores yellow toner for forming a yellow toner image.

18. An apparatus as claimed in claim 13, wherein said developing device to which the residual toner is not returned by said toner recycling device stores yellow toner for forming a yellow toner image.

19. An image forming apparatus comprising:

at least two image carriers sequentially arranged in a direction of conveyance in which a recording medium is conveyed;

developing devices each constructed to form a toner image of a particular color on one of said image carriers;

cleaning devices each constructed to remove residual toner left on a surface of one of said image carriers after a transfer of the toner image to the recording medium;

toner recycling devices each constructed to return the residual toner removed from any one of said image carriers by said cleaning device assigned to said image carrier to one of said developing devices that forms the toner image on said image carrier, wherein said toner recycling device is present between one of said cleaning devices, which removes the residual toner from an associated one of said image carriers located at a most upstream position in the direction of conveyance, and one of said developing devices assigned to said one image carrier and between another cleaning device, which removes the residual toner from at least one image carrier other than said image carrier located at the most upstream position, and another developing device assigned to said at least one image carrier, and wherein one of said developing devices, to which the residual toner is returned by said toner recycling device, located at the most downstream position stores black toner for forming a black toner image; and a controller constructed to control, at a time other than a time for transferring toner images from said image carriers to the recording medium, a mixed toner consumption mode which causes any one of said developing devices other than said developing device located at a most upstream position in the direction of conveyance to deposit the toner on an associated one of said image carriers, transfer said toner to a recording medium carrier, and causes said cleaner to remove said toner from said recording medium carrier.

20. An apparatus as claimed in claim 19, wherein one of said developing devices, which is assigned to said image carrier located at the most upstream position, stores yellow toner for forming a yellow toner image.

21. An apparatus as claimed in claim 19, wherein said developing device to which the residual toner is not returned by said toner recycling device stores yellow toner for forming a yellow toner image.

22. An image forming apparatus comprising:

at least two image carriers sequentially arranged in a direction of conveyance in which a recording medium is conveyed;

developing devices each constructed to form a toner image of a particular color on one of said image carriers;

a recording medium carrier for conveying the recording medium;

cleaning devices each constructed to remove residual toner left on a surface of one of said image carriers after a transfer of the toner image to the recording medium;

a cleaner for removing toner deposited on said recording medium carrier;

a toner recycling device provided between at least one of said cleaning devices and one developing device associated with said at least one cleaning device for returning the residual toner removed from one image carrier by said at least one cleaning device to said one developing device; and a controller constructed to control, at a time other than a time for transferring toner images from said image carriers to the recording medium, a mixed toner consumption mode which causes any one of said developing devices other than said developing device located at a most upstream position in the direction of conveyance to deposit the toner on an associated one of said image carriers, transfer said toner to said recording medium carrier, and causes said cleaner to remove said toner from said recording medium carrier.

23. An apparatus as claimed in claim 22, wherein said mixed toner consumption mode is executed with at least two developing devices every time an image forming operation is repeated a preselected number of times, and wherein said mixed toner consumption mode is executed more frequently with one developing device located at a downstream position in direction of conveyance than another developing device located at an upstream position in said direction.

24. An image forming apparatus comprising:

at least two image carriers sequentially arranged in a direction of conveyance in which a recording medium is conveyed;

developing devices each constructed to form a toner image of a particular color on one of said image carriers;

cleaning devices each constructed to remove residual toner left on a surface of one of said image carriers after a transfer of the toner image to the recording medium;

toner recycling devices each constructed to return the residual toner removed from one of said image carriers by said cleaning device assigned to said image carrier to one of said developing devices that forms the toner image on said image carrier, wherein said toner recycling device each are provided between one of said cleaning devices and one developing device assigned to one image carrier, from which said one cleaning device removes the residual toner, and wherein one of two developing devices adjoining each other in the direction of conveyance and located, at an upstream position in said direction stores toner whose margin as to color mixture is smaller than a margin of toner stored in the other developing device located at a downstream position in said direction; and a controller constructed to control, at a time other than a time for transferring toner images from said image carriers to the recording medium, a mixed toner consumption mode which causes any one of said developing devices other than said developing device located at a most upstream position in the direction of conveyance to deposit the toner on an associated one of said image carriers, transfer said toner to said recording medium carrier, and causes said cleaner to remove said toner from a recording medium carrier.

* * * * *